US005661875A

United States Patent [19]

Overcash et al.

[11] Patent Number: 5,661,875

[45] Date of Patent: Sep. 2, 1997

[54] DOOR HINGE WITH CLIP-ON STOPS

[76] Inventors: Rufus B. Overcash; Louisa C. Overcash, both of 6711 Pine Lake La., Charlotte, N.C. 28227

[21] Appl. No.: 697,587

[22] Filed: Aug. 27, 1996

[51] Int. Cl.[6] ..... E05F 5/02

[52] U.S. Cl. ..... 16/82; 16/375; 16/377

[58] Field of Search ..... 16/374, 375, 376, 16/377, 335, 336, 50, 82, 85, 86 B, DIG. 17

[56] References Cited

U.S. PATENT DOCUMENTS

| | | | |
|---|---|---|---|
| 41,664 | 2/1864 | Hoadley | 16/377 |
| 44,076 | 9/1864 | Colburn | 16/377 |
| 145,315 | 12/1873 | Thomas | 16/377 |
| 2,571,430 | 10/1951 | Durup | 16/335 |
| 2,990,572 | 7/1961 | Schwartzberg | 16/375 |
| 3,178,762 | 4/1965 | Whiting | 16/375 |
| 3,602,942 | 9/1971 | Neff | 16/375 |

*Primary Examiner*—Chuck Y. Mah
*Attorney, Agent, or Firm*—Dorothy S. Morse

[57] ABSTRACT

A door hinge which is able to selectively limit the maximum opened position of the door to which it is attached, the present invention comprising two planar members rotatably connected to one another along one lengthwise connecting edge by a hinge pin, each of the planar members having one or more small projections located on its connecting edge which outwardly angles away from the planar members so as not to interfere with their rotation, the small projections each having a leading edge and when the door to which the present invention is attached is opened, contact of each leading edge with the other leading edge defines a maximum opened position for the door, the present invention also comprising clip-on stops of varying lengths which are attached onto one of the small projections, over their leading edges, so as to further limit the extent to which the door to which it is attached can be opened. Applications may include, but are not limited to, any and all doors which would be damaged by uncontrolled opening.

3 Claims, 1 Drawing Sheet

DOOR HINGE WITH CLIP-ON STOPS

BACKGROUND—FIELD OF INVENTION

This invention relates to door hinges and door stops, specifically to a door hinge which is able to selectively limit the maximum opened position of the door to which it is attached, the present invention comprising two planar members rotatably connected to one another along one lengthwise connecting edge by a hinge pin, each of the planar members having one or more small projections located on its connecting edge which outwardly angles away from the planar members so as not to interfere with their rotation, the small projections each having a leading edge and when the door to which the present invention is attached is opened, contact of each leading edge with the other leading edge defines a maximum opened position for the door, the present invention also comprising clip-on stops of varying lengths which are attached onto the small projections, over their leading edges, so as to further limit the extent to which the door to which it is attached can be opened. Applications may include, but are not limited to, any and all doors which would be damaged by uncontrolled opening.

BACKGROUND—DESCRIPTION OF PRIOR ART

It is known to have door stops to limit the extent to which a door may be opened. One known door stop comprises a wedge shape and its tapered end is forced under the lower edge of a door, perpendicular to it, to keep the door in a fixed open position. Some wedge-shaped door stops are made of wood, or other rigid material. A disadvantage of such rigid door stops is that they can mar the lower surface of a door with repeated use. Wedge-shaped door stops have also been made of flexible material such as rubber or a flexible plastic. However, although they can be forced under the lower edge of a door without marring it, such flexible door stops have a tendency to work loose from the lower edge of the door when subjected to winds and other jostling forces.

Another prior art door stop comprises a V-shaped main body member having arms of different lengths. During use, the V-shaped door stop is secured to the top of one of the door's hinges, between the back of a door and an adjacent wall, with the plane of the V-shaped door stop positioned perpendicular to the plane of the door against which it is used. The prior art V-shaped door stop has an opening through its main body, below the intersection of its arms, through which the hinge pin securing the rotating parts of the door hinge is inserted to retain the V-shaped door stop in its usable position. The longer arm of the V-shaped door stop is positioned adjacent to the door with a flexible cushioning member positioned between the distal end of the longer arm and the door. The shorter arm has an angled projection on its distal end, the projection being angled away from the door and having a threaded aperture therethrough through which a rod with mating threads on most of its outer surface is adjustably inserted during use. Attached to the end of the rod remote from the door is a second flexible cushioning member. The extent to which the attached door may open is controlled by the positioning of the second flexible cushioning member through adjustment of the rod in the threaded aperture. When the V-shaped door stop is positioned for use, it can limit the extent to which a door is gently opened. However, when the second flexible cushioning member is positioned for routine use, occasional quick opening of the door, or opening of the door with more than a routine force, can cause the handle of the door to damage the wall surface adjacent to the door. Also, with repeated use the second flexible cushioning member usually places a permanent mark on the wall or molding to which it comes in contact. It is not known to have a door stop incorporated into the lengthwise connecting edge of a door hinge which selectively limits the maximum opened position of the door to which it is attached and which functions repeatedly without failure and without marking, or otherwise damaging, adjacent walls and molding.

SUMMARY OF INVENTION—OBJECTS AND ADVANTAGES

It is the primary object of this invention to provide a door stopping means which is incorporated into a door hinge and which selectively limits the maximum opened position of the door to which it is attached. It is also an Object of this invention to provide a door stopping means which is securely positioned so that it cannot come loose during use. A further object of this invention is to provide a door stopping means with a simple design which would be easy to manufacture. It is also an object of this invention to provide a door stopping means which is adjustable for varying maximum door opening positions.

As described herein, properly manufactured and attached to a door, the present invention would provide a door hinge with a door stopping means permanently incorporated into the connecting edges of its rotating hinge plate members. The door stopping means comprises at least one small projection depending from the connecting edge of each hinge member and angled away from the plane of its dependent hinge member. When the connecting edges are attached to one another by a hinge pin and hinge members are adjacent to one another, the angled stop projections are positioned on the outside of the hinge members. Upon rotation of the hinge members around the hinge pin to open a door, the leading edges of angled projections come in contact with one another to limit the maximum opened position of the door. Clip-on stops of varying lengths attached to one of the opposed small projections can further limit the maximum opened position of the attached door. The clip-on stops comprise a block portion and a U-shaped spring clip attached to one end of the block. The length of the clip-on stops is varied by lengthening or shortening its block. Since the door stopping means is incorporated into one or more of its hinges, there is no wedge-shaped device to become loosened from beneath the lower edge of a door, nor is there a flexible cushioning member which only stops gently opened doors to prevent them from damaging an adjacent wall. The angled stop projections attached to the connecting edge of each hinge member, as well as the clip-on stops, are simple in design and therefore would be easy to manufacture.

The description herein provides preferred embodiments of the present invention but should not be construed as limiting the scope of the door hinge invention. For example, variations in the length, width, overall shape, and thickness of each hinge plate member, the number of holes for securing the hinge plate member in place during use, the type of material from which the hinge plate members, the clip-on stops, and the angled small projections are made, the thickness of the material used to make the U-shaped spring clip portion of each clip-on stop, and the length of each of the arms of the U-shaped spring clip, other than those shown and described herein, may be incorporated into the present invention. Thus the scope of the present invention should be determined by the appended claims and their legal equivalents, rather than the examples given.

DETAILED DESCRIPTION OF PREFERRED EMBODIMENTS

Figure 1:
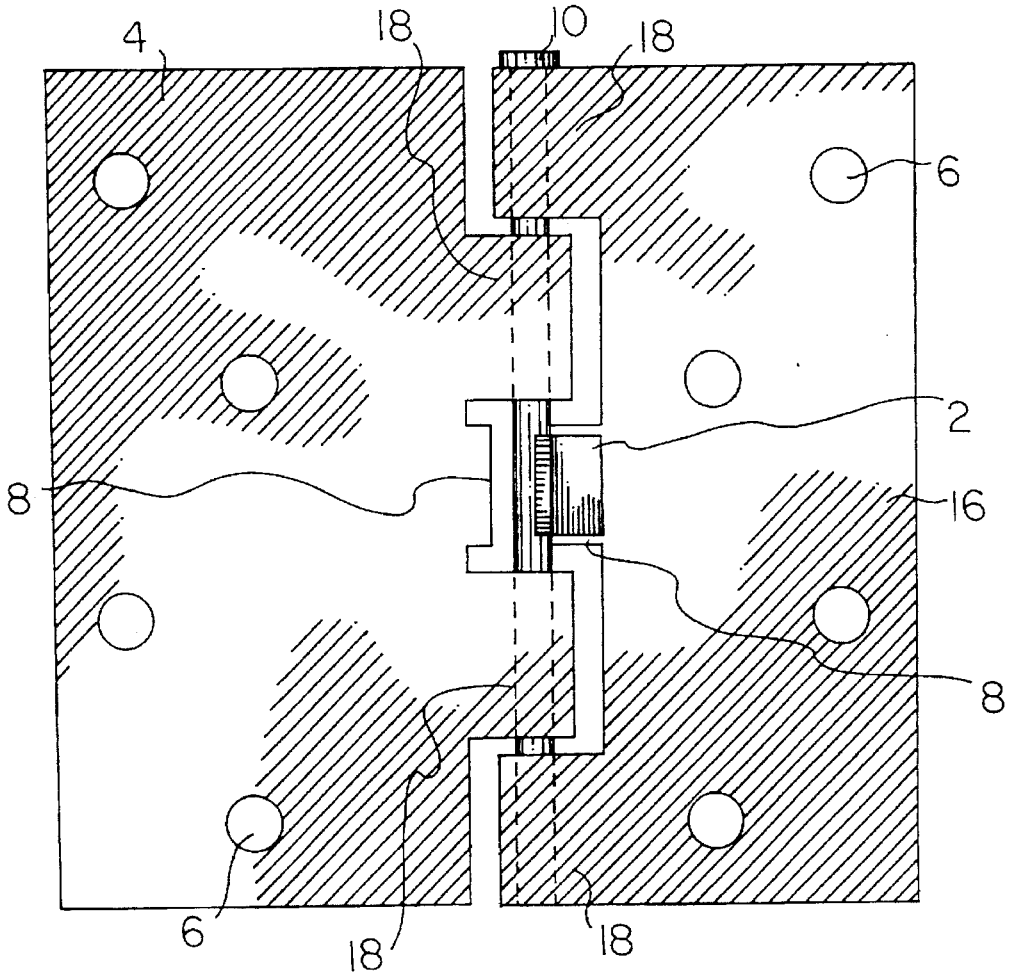
FIG. 1 is a front view of the door hinge invention in an opened position.

FIG. 1 shows a preferred embodiment of a door hinge invention 2 comprising a pair of hinge plates including first hinge member 4 and a second hinge member 16, each having a substantially rectangular configuration. Several mounting holes 6 are positioned through hinge member 4 for attaching it to a door (not shown), or the adjacent door jam (not shown), during use. Although four mounting holes 6 and a rectangular configuration are shown, the number of mounting holes 6 and the configuration of hinge member 4 are not critical to door hinge invention 2. It is contemplated for one of the longer edges of first hinge member 4 to be its connecting edge and it is shown in FIG. 1 for the connecting edge of hinge member 4 to have five distinct sections, each approximately having the same width dimension. Although five sections are shown, the number of sections is not critical to door hinge invention 2. Of the five sections shown in FIG. 1, relative to the two outermost sections which are shown to have no small stop projections 8 or hinge pin protrusions 18, the central section has a small stop projection 8 depending therefrom. The two intermediate sections of the connecting edge of first hinge member 4, those between its two outermost sections and its central section, each have a hinge pin protrusion 18 depending therefrom which extends beyond the leading edge of small stop projection 8 in the adjacent center section. Although not shown, it is contemplated for each hinge pin protrusion 18 to have an aperture therethrough dimensioned for insertion of a hinge pin 10.

Positioned adjacent to first hinge member 4, FIG. 1 shows a second hinge member 16. Second hinge member 16 is also substantially rectangular in configuration, has a plurality of mounting holes 6 therethrough, and is shown to have five sections of approximately equal width along its connecting edge. Neither the number of mounting holes 6, the number of sections, nor the configuration of second hinge member 16 is critical to door hinge invention 2. Second hinge member 16 has no small stop projections 8 or hinge pin protrusions 18 depending from its intermediate sections, one small stop projection 8 depending from its central section, and one hinge pin, protrusion 18 depending from, each of its outermost sections. Although not shown it is also contemplated for hinge pin protrusions 18 which depend from second binge member 16 to have apertures therethrough dimensioned for the insertion of hinge pin 10. During use, it is contemplated for the distal ends of hinge pin protrusions 18 on each intermediate section of first hinge member 4 to be positioned adjacent to an intermediate section of second hinge member 16 which has no hinge pin protrusion 18 or small stop projection 8 depending therefrom. Similarly, it is contemplated for the distal ends of hinge pin protrusions 18 on each outermost section of second hinge member 16 to be positioned adjacent to one outermost section of first hinge member 4 which has no hinge pin projection 18 or small stop projection 8 depending therefrom. Thus, hinge pin 10 can be inserted through all four hinge pin projections 18 to securely attach first hinge member 4 to second hinge member 16 during use. In addition, although not shown, small stop projections 8 on the central sections of both first hinge member 4 and second hinge member 16 are small enough and angled outward away from the planes of first hinge member 4 and second hinge member 16 so as not to interfere with the movement of first hinge member 4 and second hinge member 16 about hinge pin 10. Each small stop projection 8 is angled such that contact between the leading edges of each angled small stop projection 8 acts to limit the maximum opened position of the door to which it is attached. FIG. 1 also shows a clip-on stop 2 attached to small stop projection 8 on second hinge member 16.

Figure 2:
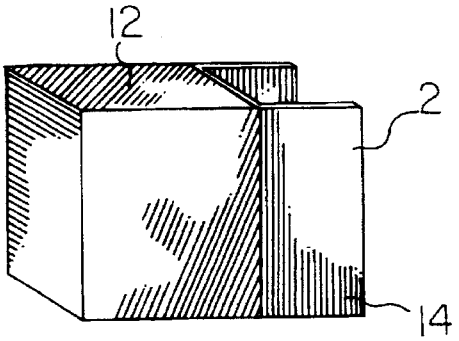
FIG. 2 is a perspective view of the clip-on stop of the invention with a block which is greater in length than the arms of the U-shaped spring clip to which it is attached.
Figure 3:
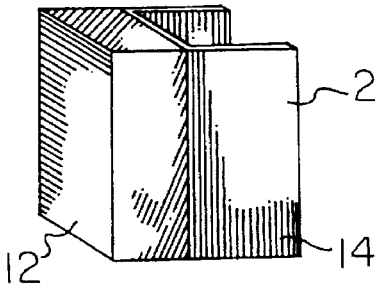
FIG. 3 is a perspective view of the clip-on stop of the invention with a block which is similar in length to the arms of the U-shaped spring clip to which it is attached.

FIGS. 2 and 3 show clip-on stops 2 of differing lengths, each having a U-shaped spring clip 14 attached to a block 12. In FIG. 2 block 12 has a greater length dimension than of U-shaped spring clip 14, while in FIG. 3 the length dimension of block 12 is similar to the length dimension of U-shaped spring clip 14. Use of blocks 12 having different lengths, when door hinge invention 2 is attached between a door (not shown) and an adjacent door jam (not shown), permit the door to have different maximum opened positions. In the preferred embodiment it is contemplated for clip-on stops 2 to be either snap-fit onto small stop projections 8 or welded thereto.

In the preferred embodiment it is contemplated for first hinge member 4, second hinge member 16, U-shaped spring clip 14, and block 12 all to be made from a strong metallic material which would effectively attach a door (not shown) to a door jam (not shown) and also provide effective stopping means for the door so that the door does not move beyond a desired maximum opened position. Although not shown, during use door hinge invention 2 would be attached between a door and a door jam so that when the door is in its closed position, angled small stop projections 8, and any clip-on stop 2 attached thereto, are adjacent to the door or the door jam and not positioned between first hinge member 4 and second hinge member 16. When opened, the door to which door hinge invention 2 is attached will move to a maximum opened position which is established when the leading edges of small stop projections 8 come in contact with one another, or if a clip-on stop 2 is used, when the end of block 12 remote from U-shaped spring clip 14 comes into contact with the leading edge of the small stop projection 8 opposed to it.

What is claimed is:

1. A door hinge for use in selectively limiting the maximum opened position of a door to which it is attached, said door hinge comprising a hinge pin; a pair of hinge plates connected together by said hinge pin, each of said hinge plates having a plurality of mounting holes therethrough and a connecting edge, each of said connecting edges having a plurality of protrusions depending therefrom and at least one stop projection also depending therefrom, said stop projections on each of said hinge plates being in a position opposed to a stop projection on the connecting edge of the other of said hinge plates, each of said protrusions having an aperture therethrough of sufficient dimension for insertion therethrough of said hinge pin, each of said stop projections having a leading edge and being positioned at an oblique angle to the one of said hinge plates to which it is attached; and said door hinge further comprising a plurality of removable clip-on stops each having a block and a U-shaped spring clip depending from said block, said blocks having different length dimensions, a selected one of said clip-on stops being attached to one of said stop projections on one of said hinge plates so that when said hinge pin is inserted through said apertures to connect one of said connecting edges to the other of said connecting edges said clip-on stop will oppose said leading edge on the opposed one of said stop projections to define the maximum opened position of a door to which said door hinge is attached, and when it is desired for said door to have a different maximum opened position a stop having a block with a different length dimension can be selected and positioned over one of said stop projections to define said different maximum opened position for said door.

2. The door hinge of claim 1 whereto said hinge plates each have a substantially rectangular configuration and each comprise two of said protrusions and one of said stop projections.

3. The door hinge of claim 1 wherein said connecting edges each have more than one stop projection depending therefrom and wherein at least two of said clip-on stops are each removably positioned over a different one of said stop projections so as to together define the maximum opened position of a door to which said door hinge is attached.

* * * * *